US009587191B2

(12) United States Patent
Isbilen et al.

(10) Patent No.: US 9,587,191 B2
(45) Date of Patent: Mar. 7, 2017

(54) SULPHUR-FREE GAS ODORANT

(71) Applicant: Aygaz Anonim Sirketi, Istanbul (TR)

(72) Inventors: Emrah Isbilen, Istanbul (TR); Kerem Kadayifcioglu, Istanbul (TR); Muzaffer Yasar, Istanbul (TR); Utku Doldur, Istanbul (TR)

(73) Assignee: Aygaz Anonim Sirketi, Istanbul (TR)

( * ) Notice: Subject to any disclaimer, the term of this patent is extended or adjusted under 35 U.S.C. 154(b) by 0 days.

(21) Appl. No.: 15/026,347

(22) PCT Filed: Sep. 9, 2014

(86) PCT No.: PCT/TR2014/000336
§ 371 (c)(1),
(2) Date: Mar. 31, 2016

(87) PCT Pub. No.: WO2015/050509
PCT Pub. Date: Apr. 9, 2015

(65) Prior Publication Data

US 2016/0215226 A1 Jul. 28, 2016

(30) Foreign Application Priority Data

Oct. 1, 2013 (TR) ..... a 2013 11505

(51) Int. Cl.
*C10L 3/12* (2006.01)
*C10L 1/00* (2006.01)
*C10L 3/00* (2006.01)

(52) U.S. Cl.
CPC ..... *C10L 3/006* (2013.01); *C10L 3/12* (2013.01); *C10L 2200/029* (2013.01); *C10L 2200/0254* (2013.01); *C10L 2200/0415* (2013.01); *C10L 2230/10* (2013.01)

(58) Field of Classification Search
CPC ..... C10L 3/006; C10L 1/18
See application file for complete search history.

(56) References Cited

U.S. PATENT DOCUMENTS

| | | | |
|---|---|---|---|
| 2,430,050 | A | 11/1947 | Gill |
| 8,354,043 | B2 | 1/2013 | Flynn et al. |
| 2004/0031314 | A1 | 2/2004 | Flynn et al. |
| 2006/0009372 | A1 | 1/2006 | Mansfeld et al. |

FOREIGN PATENT DOCUMENTS

| | | | |
|---|---|---|---|
| DE | 3151215 | A1 | 7/1982 |
| DE | 198 37 066 | A1 | 2/2000 |
| GB | 2 089 834 | A | 6/1982 |
| JP | S51-021402 | A | 2/1976 |
| JP | S51-034841 | A | 3/1976 |
| JP | S55-056190 | A | 4/1980 |
| WO | WO 2006/067112 | A1 | 6/2006 |

OTHER PUBLICATIONS

International Search Report, dated Mar. 20, 2015, pp. 1-10, issued in International Patent Application No. PCT/TR2014/000336, European Patent Office, Rijswijk, The Netherlands.

International Preliminary Report on Patentability, dated Jan. 4, 2016, pp. 1-6, issued in International Patent Application No. PCT/TR2014/000336, European Patent Office, Munich, Germany.

*Primary Examiner* — Matthew Merkling
(74) *Attorney, Agent, or Firm* — Brinks Gilson & Lione

(57) ABSTRACT

The present invention relates to a sulphur-free odorizing composition to be added into liquefied petroleum gas (LPG) in order to allow the user to sense any leakage in case of LPG leakages which might occur in the area of utilization.

4 Claims, 1 Drawing Sheet

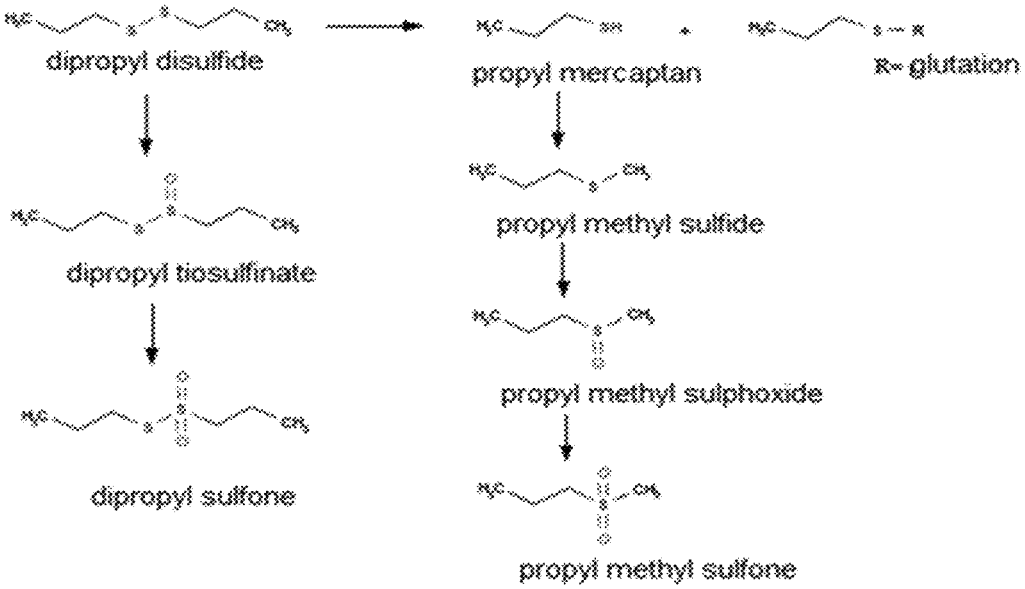
dipropyl disulfide
propyl mercaptan
R= glutation
dipropyl tiosulfinate
propyl methyl sulfide
propyl methyl sulphoxide
dipropyl sulfone
propyl methyl sulfone

SULPHUR-FREE GAS ODORANT

CROSS REFERENCE TO PRIOR APPLICATIONS

This application is a National Stage application of International Application No. PCT/TR2014/000336, filed Sep. 9, 2014. This application also claims priority under 35 U.S.C. §119 to Turkish Patent Application No. 2013/11505, filed Oct. 1, 2013.

TECHNICAL FIELD

The present disclosure relates to a sulphur-free odorizing composition to be added into liquefied petroleum gas (LPG) in order to allow a user to sense any leakage in case of LPG leakages which might occur in the area of utilization.

BACKGROUND

Gas odorization has become a part of daily life especially with the widespread utilization of natural gas in households and industry, and measures to be taken in terms of security are of vital importance. Since natural gas which is not supplied for utilization (>95% methane gas) is odorless, it cannot be sensed by the users in case of any leakage. In order to enable that any possible natural gas leakages are detected before its concentration in air reaches to the lower flammability limit, mercaptan compounds have been started to be added into natural gas since 1940s. LPG is a byproduct of natural gas and petroleum refining processes and it is supplied from the points where the said refining is performed. The supplied LPG may comprise sulphur containing compounds, in various types and proportions, according to the source of production. While sulphurous compounds may be contained in LPG obtained from refining of crude petroleum in various types and higher amounts depending on the refining process, they are generally lower in LPG originating from natural gas. Based on that, LPG presents a characteristic odor profile due to sulphur compounds contained. Depending on the amount of sulphurous compounds in LPG, it might not be necessary to additionally odorize it in certain cases. On the other hand, LPG which contains lower proportions of sulphur compounds is subjected to odorization. In the selection of the odorants used in odorizing, a criterion is applied which is based on the fact that LPG odor, in terms of its odor nature, is unpleasant and distinctive from odors which can be easily encountered in daily life. Currently, among the main odorizing chemicals widely used in the LPG sector in the world, sulphurous compounds such as methyl mercaptan, ethyl mercaptan, t-butyl mercaptan, n-propyl mercaptan, isopropyl mercaptan or tetrahydrothiophene, dimethyl sulfide and diethyl sulfide are included. Apart from the nature of the odor, other important criteria used in the selection of the said odorants are intensity of the odor, and the physical and chemical characteristics of the odorants. LPG is a fuel used in various areas, which is used in heating, cooking, illumination, as vehicle fuel and as propellant in perfumes. Most of these utilization areas necessitates that LPG that is procured to the consumer is odorized.

An odorant commonly used in LPG sector is Ethyl Mercaptan (EM), which contains sulphur at a level of 52% in its molecular structure. In order to comply with the condition of TS EN 589 standard which stipulates that 'The odor of the gas should be specific (distinctive and unpleasant) and its odor should be detectable when its concentration in air is less than 20% of its lower flammability limit', the amount of EM dosed into LPG is approximately 20 ppm depending on the odor description threshold and volatility of EM. The lower and upper explosion limits of Liquefied Petroleum Gas-air mixture are 1.55% and 9.6%, respectively. This EM sulphurous compound of 20 ppm added additionally in LPG increases the sulphur content of LPG by approximately 10 ppm. As a result of this EM addition, the sulphur content in 1 ton of LPG is increased by 10 gr. Considering 3.5 million tons of LPG market, this value corresponds to approximately 35 tons of elemental sulphur content. As a result of conversion of 35 tons of sulphur into $SO_2$ gases in engine and combustion systems, $SO_2$ emissions increase.

In automotive sector, for purposes of converting environmentally hazardous exhaust gases that are released during fuel consumption, into less hazardous gases through oxidation, catalytic converters are used in vehicles. Due to the susceptibility of the catalyst substances (Pt—Rh/$CeO_2$—$Al_2O_3$) used in catalytic converters to sulphur, exhaust gases with high sulphur content increase the amount of hazardous gas released into the atmosphere by negatively affecting oxidation performances of the catalytic converters. Such effect of sulphur on catalyst substances is not permanent, and with a decrease in the sulphur content of the fuel used, the negative effect on the oxidation performance disappears. In this respect, decreasing the sulphur content of LPG used as auto-gas will not only result in a decrease in $SO_2$ emissions, but also in the emission amounts of all hazardous exhaust gases emitted into the environment during auto-gas consumption.

Liquefied Petroleum Gas means liquid gas which can be converted into liquid phase generally at 20° C. and under 3.5 Bar pressure. Basically, it consists of n-propane, propylene, n-butane and butylene. With a narrower description, it is liquid gas consisting of mixtures of n-propane and n-butane. This mixture may contain low amounts of unsaturated hydrocarbons and/or branched hydrocarbons such as propylene, isobutane, 1-butylen, cis-2-butylene, trans-2-butylene or isobutylene.

Liquefied Petroleum Gas is generally transported without going through any odorizing process. Odorizing process is performed at the storage facilities. During the odorizing process, the storage tank is supported with nitrogen against explosion risk. According to TS TSE/TS 8038 Standard, the amount of odorant required to be added into Liquefied Petroleum Gas is calculated as follows: when the concentration of the gas in air is equal to 20% of the lower explosion limit, in order to allow the odor to reach warning level, the required odorant concentration (C) in Liquefied Petroleum Gas can be roughly calculated with the following formula, in $mg/m^3$: $C=(K.100)/(0.2.APS)$ Wherein, K defines the odor sensing threshold. K values for certain odorants are as follows:

| Odorant | K value, $mg/m^3$ |
|---|---|
| Tetrahydrothiophene | 0.075 |
| Mercaptans | 0.04-0.09 |
| Dimethyl sulphur | 0.28 |

Sulphur compounds are often used in liquefied petroleum gas compositions. Sulphurous compounds are hazardous to human health, environment and machine parts. When using odorants containing sulphurous compounds, and such odorants are used with LPG, emissions arising from consumption of LPG as bottled gas and auto-gas have adverse effects on humans and other living creatures in terms of below mentioned aspects. With the utilization of sulphur-free odorant, the said adverse effects will be eliminated.

Hazards to Humans and Other Living Creatures

Compounds containing sulphur, when exposed to high amounts thereof, may cause damage on the cell structure of living creatures. Thioltransference, which catalyzes substitution reaction with glutathione and shows high degree of activity in the organs and tissues, is affected in the first order by the dialkyl disulfide toxicity (Lillig and Holmgren, 2007). The reaction mechanism is quite important because it is related with the free radical medium with excessive and high reactivity, which may initiate the redox cycle in tissue macromolecules or in the sites they form (FIG. 1).

The mechanism of free radical formation from dialkyl disulfide and the reaction steps of redox cycle are shown below (Munday and Manns, 1994). The first product of thiol transference substitution reaction is an alkyl mercaptan (1); after being ionized, undergoes a single electron oxidation (2) and free radical intermediate phase occurs. This intermediate product is toxic and it is a constant hydroxyl radical producer and other reactive oxygen examples can maintain the redox cycle (3, 4, 5, 6) and they cause oxidative stress and tissue damage in the sites they form.

$$2\ GSH + RSSR \leftrightarrow GSSG + 2\ RSH \quad (1)$$

$$RSH \leftrightarrow RS^{-} + H^{+} \quad (2)$$

$$(Hb)Fe^{3}O_2^{\bullet-} + RS^{-} + 2H^{+} \rightarrow (Hb)Fe^{3} + RS^{\bullet} + H_2O_2 \quad (3)$$

$$RS^{\bullet} + RS^{-} \leftrightarrow (RSSR)^{\bullet-} \quad (4)$$

$$(RSSR)^{\bullet-} + O_2 \rightarrow RSSR + O_2^{\bullet-} \quad (5)$$

$$RSH + O_2^{\bullet-} + H^{+} \rightarrow RS^{\bullet} + H_2O_2 \quad (6)$$

Long chain lengths in a molecule decrease the radical stability, thereby reducing oxidation rate (Munday, 1989). Furthermore, the reactivity and toxicity of alkyl disulfides is reduced as follows due to the effect of steric factors on the thioltransference activity: n>sec>tert. According to this information DMDS is the most reactive member of the homologous sequence in terms of chain length and branching.

Additionally, Fe and its oxides cause damages to the storage tanks by showing the following reactions with $H_2S$:

$$Fe + H_2S \rightarrow FeS + H_2 \quad (7)$$

$$Fe_2O_3 + 3H_2S \rightarrow 2FeS + 3H_2O + S \quad (8)$$

$$2Fe(OH)_3 + 3H_2S \rightarrow 2FeS + 6H_2O + S \quad (9)$$

$$Fe(OH)_3 + 3H_2S \rightarrow Fe_2S_3 + 6H_2O \quad (10)$$

$$Fe_3O_4 + 4H_2S \rightarrow 3FeS + 4H_2O + S \quad (11)$$

Acid Rains

Combustion of sulphurous fossil fuels is the main source of $SO_x$. Formation of $SO_x$ results from $SO_2$ arising out of combustion, in a proportion between 97% and 99%. The remaining part is mostly sulphur trioxide ($SO_3$). This compound available in the atmospheric water vapor rapidly transforms into $H_2SO_4$. When in sufficient concentrations, $SO_2$ and $H_2SO_4$ are hazardous to respiratory system. Besides, $SO_2$ is also toxic to plants (U.S. EPA, 1999).

Catalytic Converter Intoxication

Sulphur intoxication is a complicated event which alters the structural, morphological and electronic characteristics of the catalyzer (Rodriguez & Hrbek 1999). Sulphur negatively affects the activity and oxygen storage capacity of the catalyst (Boaro et al. 2001, Yu & Shaw, 1998). The existence of sulphur may cause formation of new inactive compounds on the surface of the catalyst. Furthermore, it may also cause structural changes in the catalyst (Yu & Shaw, 1998).

Depending on the temperature and partial pressure of oxygen, sulphur contained in the exhaust gas may be converted into sulfate, sulfide or oxy-sulfides by the catalyst (Karjalainen et al. 2005). At temperatures below 300° C., these oxides are adsorbed by the active surfaces on the surface of the catalyst and reduce the active surface, so the efficiency of the catalyst decreases. Under reduction conditions, sulphur forms $H_2S$ and intoxicates metal surfaces, and negatively affects the oxidation of hydrocarbons (Rabinowitz et al., 2001). In case of a rich mixture of $SO_2$, sulphur deactivation is more important in the presence of $NO_x$, and even at 1000° C. very stable sulfates may form, without being attacked by reducing agents, especially in the absence of water (Fridell et al. 2001, Mahzoul et al. 2001).

BRIEF DESCRIPTION

The present disclosure relates to a gas odorant composition comprising methyl acrylate and/or ethyl acrylate and/or isovaleraldehyde and at least one selenium compound used in odorizing liquefied petroleum gas, wherein the said selenium compound is selected from the group consisting of dimethyl selenide, dimethyl diselenide, diethyl selenide, diphenyl selenide, diphenyl diselenide or ethyl selenol.

An aspect of the embodiments is to provide an odorant composition consisting of isovaleraldehyde and/or methyl acrylate and/or ethyl acrylate and preferably at least one selenium compound to odorize liquefied petroleum gas, which is free of sulphur and which does not involve the adverse effects caused by sulphurous compounds. The said adverse effects are environmental pollution, corrosion of the materials, and sulphur related intoxication of catalytic converter.

Another aspect of the embodiments is to increase the efficiency of fuel combustion reactions with the addition of selenium compounds into the odorant composition used in odorizing liquefied petroleum gas and to prevent formation and accumulation of soot in engine cylinder blocks.

DESCRIPTION OF THE FIGURES

FIG. 1 is the reaction steps in the In Vivo metabolism of dialkyl disulfides.

DETAILED DESCRIPTION

The odorant composition disclosed consists of different concentrations of isovaleraldehyde, methyl acrylate, ethyl acrylate and selenium compounds; preferably, dimethyl selenide compound. Particularly, the composition is free of sulphur. Odorants containing sulphur compounds and $SO_2$ gases resulting from combustion thereof in vehicle engine cylinders and gas furnaces, cause air pollution, which may result in respiratory tract diseases. When exposed to high amounts, sulphurous compounds may result in molecular damages especially for living creatures. For vehicles that use Liquefied Petroleum Gas, sulphurous compounds cause corrosion and accumulation in the metal and plastic parts, which shortens the life of the material. On the other hand, since the inventive sulphur-free odorant has an oxygenized organic compound structure, the $CO_2$ and $H_2O$ resulting from combustion do not harm human health. With the present invention, isovaleraldehyde, ethyl acrylate and methyl acrylate compounds along with selenol compounds are used instead of sulphur compounds. Selenol compounds such as dimethyl selenide compound increase the efficiency of combustion reactions by inhibiting the aromatization reactions which cause coke formation during combustion. Selenol compounds added into LPG as odorant prevent the formation and accumulation of soot in the engine cylinder blocks during combustion reactions. The chemical structures of methyl acrylate, ethyl acrylate and isovaleraldehyde are given in Formula 1, Formula 2 and Formula 3, respectively.

Formula 1

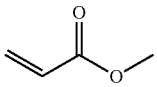

Formula 2

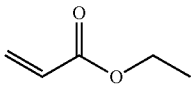

Formula 3

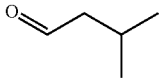

Selenium compounds to be used are selected from dimethylselenide shown in Formula 4, Formula 4

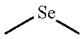

dimethyl diselenide shown in Formula 5,

Formula 5

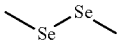

diethyl selenide shown in Formula 6,

Formula 6

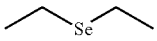

diphenyl selenide shown in Formula 7,

Formula 7

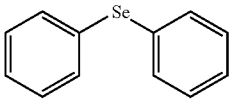

diphenyl diselenide shown in Formula 8, or

Formula 8

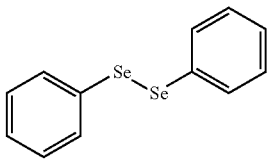

ethyl selenol shown in Formula 9.

Formula 9

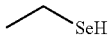

In the illustrative embodiments, selenium compound is selected preferably as dimethyl selenide. In Table 1, physical characteristics of methyl acrylate, ethyl acrylate, isovaleraldehyde and dimethyl selenide compounds are given.

TABLE 1

| Compound | Boiling Point (° C.) | Melting Point (° C.) | Odor threshold value (ppbv) | Vapor pressure (mmHg @ 20° C.) |
|---|---|---|---|---|
| Methyl acrylate | 80.0 | −76 | 14 | 67.5 |
| Ethyl acrylate | 99.4 | −72 | 0.5 | 31 |
| Isovaleraldehyde | 90 | −51 | 0.1-2 | 30 |
| Dimethyl selenide | 57-58 | — | — | 238 |

Isovaleraldehyde is available in the nature in more than one hundred eighty plants, including foods like banana, apple, carrot, cacao, and coffee. Furthermore, in the food industry, aroma of these plants is also used in amino acids production in medical applications. It is used in pharmaceutical industry for anti-viral protection and central nervous system disease drugs and as excipient.

The odorant consists of different concentrations of mixtures of isovaleraldehyde, methyl acrylate, ethyl acrylate and dimethyl selenide chemicals. In this respect, the odorant is suitable for Liquefied Petroleum Gas chemically and physically and it is completely sulphur-free. Therefore, air pollution arising from sulphur and resultant respiratory tract diseases as well as problems arising from sulphur accumulation in vehicles will be eliminated.

Selenium forms weaker σ-bonds than sulphur. Compared to sulphurous compounds, these bonds break more easily in selenium compounds and they liberate. Selenium easily oxides into Se(IV).

Organoselenium compounds may be easily attacked by nucleophile. This prevents soot accumulation in a long period of time by delaying polymerization to which heavy hydrocarbon structures, which are possibly available in LPG and cause serious problems in engine parts depending on long term utilization, may be subjected over time depending on combustion.

Carbon-selenium bonds of SeC, $H_2Cse$ and $H_3CseH$ compounds are defined as 1.676 Å, 1.756 Å and 1.959 Å, respectively (Determan and Wilson, 2013). However, the carbon-sulphur bond which is approximately 1.39-1.40 Å in sulphurous compounds renders the structure more robust (Schreiner et al., 2009). 234 kJ/mol energy is required to break C—Se bonds while C—S bonds require an energy level of 272 kJ/mol (Krief, 1988; Patai et al., 1986; Paulmier, 1986; Freudendahl, 2009 and Wallschläger, 2010).

Illustrative compounds are given below.

Example 1

| Compound | Quantity (ppmw) | Odor intensity (Sales Diagram) |
|---|---|---|
| Methyl acrylate | 40 | 4 |
| Ethyl acrylate | 50 | |
| Iso valeraldehyde | 50 | |
| Dimethyl selenide | 10 | |

Example 2

| Compound | Quantity (ppmw) | Odor intensity (Sales Diagram) |
|---|---|---|
| Ethyl acrylate | 25 | 3 |
| Iso valeraldehyde | 70 | |
| Dimethyl selenide | 5 | |

Example 3

| Compound | Quantity (ppmw) | Odor intensity (Sales Diagram) |
|---|---|---|
| Methyl acrylate | 5 | 3 |
| Ethyl acrylate | 20 | |
| Iso valeraldehyde | 70 | |
| Dimethyl selenide | 5 | |

Example 4

| Compound | Quantity (ppmw) | Odor intensity (Sales Diagram) |
|---|---|---|
| Methyl acrylate | 10 | 3 |
| Ethyl acrylate | 20 | |
| Iso valeraldehyde | 60 | |
| Dimethyl selenide | 10 | |

Example 5

| Compound | Quantity (ppmw) | Odor intensity (Sales Diagram) |
|---|---|---|
| Methyl acrylate | 25 | 2 |
| Ethyl acrylate | 20 | |
| Iso valeraldehyde | 50 | |
| Dimethyl selenide | 5 | |

Example 6

| Compound | Quantity (ppmw) | Odor intensity (Sales Diagram) |
|---|---|---|
| Methyl acrylate | 30 | |
| Ethyl acrylate | 20 | |
| Iso valeraldehyde | 40 | 2 |
| Dimethyl selenide | 10 | |

Example 7

| Compound | Quantity (ppmw) | Odor intensity (Sales Diagram) |
|---|---|---|
| Methyl acrylate | 45 | 2 |
| Ethyl acrylate | 20 | |
| Iso valeraldehyde | 30 | |
| Dimethyl selenide | 5 | |

It will be readily apparent to one of ordinary skill in the relevant arts that suitable modifications and adaptations to the compositions, methods, and applications described herein can be made without departing from the scope of any embodiments or aspects thereof. The compositions and methods provided are exemplary and are not intended to limit the scope of any of the specified embodiments. All of the various embodiments, aspects, and options disclosed herein can be combined in any and all variations or iterations. The scope of the compositions, formulations, methods and processes described herein include all actual or potential combinations of embodiments, aspects, options, examples, and preferences herein described. All patents and publications cited herein are incorporated by reference for the specific teachings thereof.

The invention claimed is:

1. A sulfur-free gas odorant composition for liquefied petroleum gas, comprising ethyl acrylate, isovaleraldehyde and dimethyl selenide.

2. A sulphur-free gas odorant composition according to claim 1 comprising methyl acrylate.

3. A sulphur-free gas odorant composition according to claim 1, comprising 0-50% methyl acrylate, 10-40% ethyl acrylate, 25-75% isovaleraldehyde, 2-10% dimethyl selenide by weight.

4. A sulphur-free gas odorant composition according to claim 1, comprising 10-40% ethyl acrylate, 25-75% isovaleraldehyde, 2-10% dimethyl selenide by weight.

* * * * *